United States Patent [19]

Tanahashi

[11] 4,146,251

[45] Mar. 27, 1979

[54] SKI

[75] Inventor: Ryoji Tanahashi, Hamamatsu, Japan

[73] Assignee: Nippon Gakki Seizo Kabushiki Kaisha, Hamamatsu, Japan

[21] Appl. No.: 807,916

[22] Filed: Jun. 20, 1977

[30] Foreign Application Priority Data

Jun. 23, 1976 [JP] Japan ..... 51-74126

[51] Int. Cl.[2] ..... A63C 5/12

[52] U.S. Cl. ..... 280/610

[58] Field of Search ..... 280/610, 601

[56] References Cited

U.S. PATENT DOCUMENTS

| | | | |
|---|---|---|---|
| 2,928,456 | 3/1960 | Potchen et al. | 280/610 |
| 3,707,296 | 12/1972 | Palazzolo et al. | 280/610 |
| 3,801,116 | 4/1974 | Benner | 280/610 |
| 3,901,522 | 8/1975 | Boehm | 280/610 |
| 3,902,732 | 9/1975 | Fosha et al. | 280/610 |
| 3,915,465 | 10/1975 | Matsuda | 280/610 |

*Primary Examiner*—David M. Mitchell

*Attorney, Agent, or Firm*—Lerner, David, Littenberg & Samuel

[57] ABSTRACT

The core structure of a ski board has a heterogeneous internal construction formed of superposed layers of materials having significantly different Young's moduli to impede transmission of impulsive elastic waves therethrough, thereby mitigating direct transfer of impact load imposed on the ski to the skier's feet. Further use of prepreg layers for bonding the superposed layers results in highly internal energy-packed construction making the ski keenly responsive and predictable and thereby giving the skier a smooth, lively "feel", combined with great tolerance.

27 Claims, 8 Drawing Figures

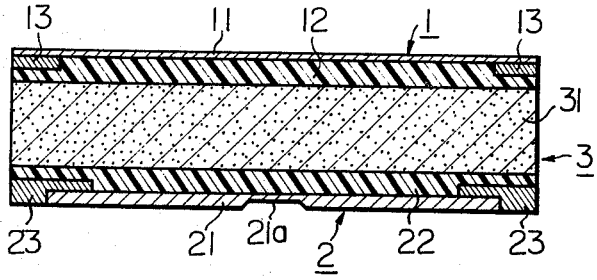
Fig. 1A
PRIOR ART
Fig. 1B
PRIOR ART
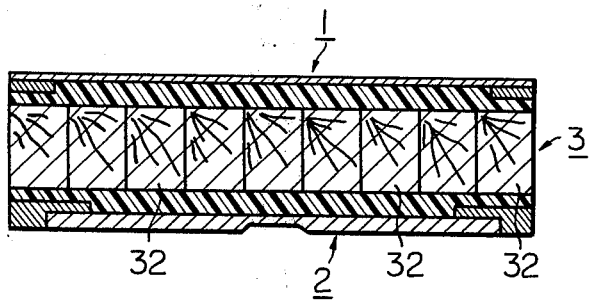
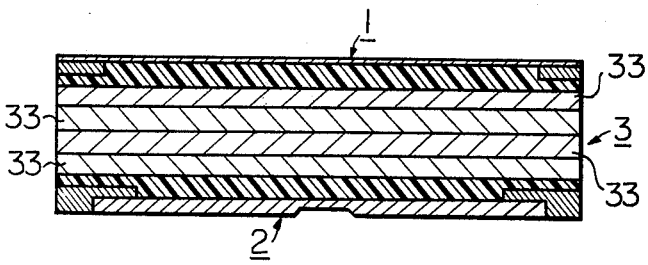
Fig. 1C
PRIOR ART
Fig. 2
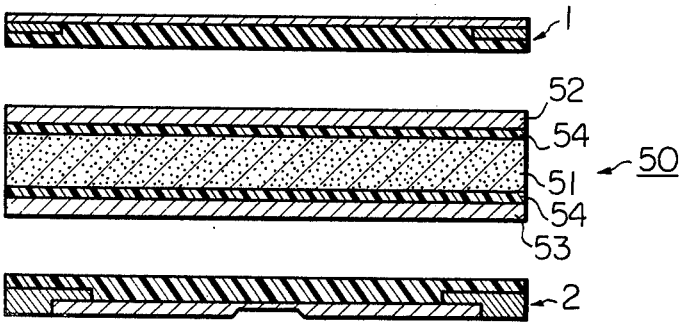

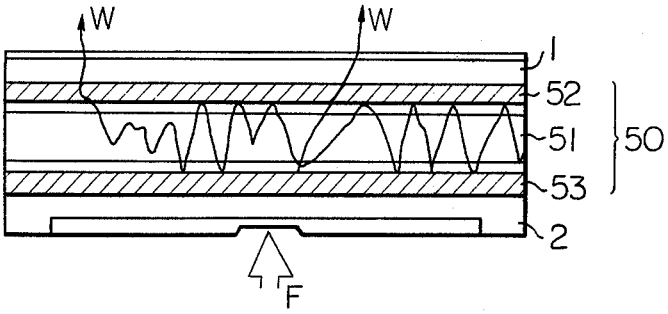
Fig. 3
Fig. 4
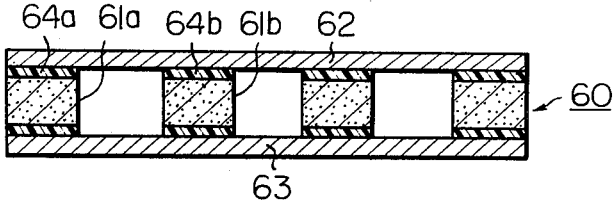
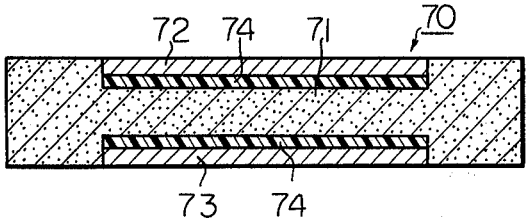
Fig. 5
Fig. 6
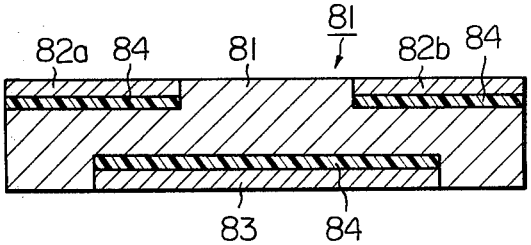

SKI

BACKGROUND OF THE INVENTION

The present invention relates to an improved ski, and more particularly relates to an improved core structure of a ski having a remarkably enhanced impedance against direct transfer of impact load imposed on the ski to the skier's feet.

A ski is generally comprised of top and bottom structures fixedly sandwiching a core structure and most of the conventional core structures are provided with relatively homogeneous internal constructions which are well suited for smooth transmission of elastic waves therethrough due to absence of discontinuity in material and construction. Even in cases where the internal construction of the core structure is more or less discontinuous, e.g. in the case of a plyboard construction, the material composing the whole core structure is homogeneous in the mechanical property thereof, which is again well suited for smooth transmission of elastic waves therethrough. In some cases, the components forming the plyboard construction are made of a material having a relatively low Young's modulus such as ABS resin, which particularly allows easy transmission of elastic waves therethrough.

As is well known, various impact loads act on the ski during skiing and the impact loads so imposed on the ski, more particularly on the bottom structure of the ski, are transferred to the skier's feet taking the form of impulsive elastic waves transmitted through the core structure of the ski.

The above-described low impedance against elastic waves transmission characteristic to the conventional core structure thus naturally allows smooth transmission of the impulsive elastic waves generated by impact loads imposed of the ski without any substantial damping of the impact loads. Such direct and intact transfer of the impact loads to skier's feet cause undesirable fatigue and, in extreme cases, damage to the skier's feet, and gives the skier a disgruntled "feel".

SUMMARY OF THE INVENTION

It is an object of the present invention to provide a ski almost free of direct and intact transfer of impact load to skier's feet.

It is another object of the present invention to provide a ski capable of remarkably reducing fatigue and damage on skier's feet.

It is still another object of the present invention to provide a ski which is keenly responsive and predictable and giving skiers a beautifully comfortable "feel".

In accordance with one aspect of the present invention, the core structure of a ski has a heterogeneous internal construction formed of superposed layers of materials having significantly different Young's moduli. More particularly, the core structure comprises a core body made of a material having a lower Young's modulus and at least one layer made of a material having a higher Young's modulus and at least partly covering one of the upper and lower surfaces of the core body. Preferably, the core body and the covering layer coupled to each other via a bonding layer made of a material such as thermosetting resin preimpregnated glass fibers (so-called prepreg).

BRIEF DESCRIPTION OF DRAWINGS

FIGS. 1A through 1C are transverse cross sectional views of several examples of the conventional ski, FIG. 2 is a transverse cross sectional view of one embodiment of the ski in accordance with the present invention in a disassembled state, FIG. 3 is an explanatory view for showing elastic waves damping function of the ski shown in FIG. 2, and FIGS. 4 through 6 are transverse cross sectional views of various modifications of the core structure of the ski in accordance with the present invention.

DETAILED DESCRIPTION OF THE INVENTION

Some typical examples of the transverse cross sectional internal construction of the conventional ski are shown in FIGS. 1A and 1B. As well known, the internal construction of a ski is in general comprised of an upper structure, a bottom structure and a core structure fixedly sandwiched by the two structures.

In the construction shown in FIG. 1A, the upper structure 1 comprises a top board 11, a plastic layer 12 located beneath the top board 11 and edge pieces 13 disposed to the upper corners of the plastic layer 12. The bottom structure 2 comprises a sole board 21 having an elongated center groove 21*a* formed in the bottom thereof, a plastic layer 22 located on the sole board 21 and sole edges 23 disposed to the bottom corners of the ski. The core structure 3 in the illustrated example takes the form of a unitary homogeneous core 31 made of a material such as wood, foamed synthetic resin and fiber reinforced plastics.

The core structure 3 of the example shown in FIG. 1B is comprised of a plurality of blocks 32 which are arranged in a side-by-side fashion and each extending in the longitudinal direction of the ski. Though separated into blocks, the blocks 32 are in general made of a similar material. Thus, the core structure 3 as a whole is substantially homogeneous in the internal construction thereof. In the case of the illustrated example, the core structure is made up of several wood blocks.

A plyboard construction is employed in the core structure 3 of the example shown in FIG. 1C, in which the core structure 3 is made up of a plurality of thin flat boards 33 fixedly superposed to each other. Though separated into boards, the boards 33 are in general made of a similar material and, thus, the core structure 3 as a whole is substantially homogeneous in the internal construction thereof. The boards 33 forming the plyboard construction are in general made of a material having a relatively low Young's modulus such as ABS resin. It is well known that transmission of elastic waves generated by impact load through a body is particularly ideal when the body has a homogeneous and/or unitary internal construction. It is further known that transmission of the above-described impulsive elastic waves through a body is particularly prevalent when the body is made of a material having low Young's modulus. Discontinuity in the internal construction and heterogeneity in the material of a body considerably impedes smooth transmission of the above-described impulsive elastic waves through the body. Further, the higher the Young's modulus of the material composing a body, the poorer the transmission of the impulsive elastic waves through the body.

Returning to the construction shown in FIG. 1A, the core structure 3 is given in the form of a unitary homogeneous core 31 which allows easy multidirectional transmission of elastic waves. Thus, the impact load exerted upon the bottom surface of the ski main body during skiing from the snow surface is easily transferred to the skier's, feet without any substantial damping during transmission through the ski main body made up of the upper, core and bottom structures.

In the case of the construction shown in FIG. 1B, it is true that the core structure 3 is in some sense discontinuous in the lateral (width) direction but each block 32 is completely continuous in the thickness direction and the blocks 32 are in general made of a similar material. Thus, there is no substantial impedance against transmission of the impulsive elastic waves in the thickness direction of the ski main body, i.e. from bottom to top. That is, similar to the first example, the impact load acting on the bottom surface of the ski main body is easily transferred to the skier's feet.

In the construction shown in FIG. 1C, discontinuity in the thickness direction of the core structure 3 due to the plyboard construction is more or less compensated by the relatively low Young's modulus of the material composing the thin boards 33, which allows easy transmission of the impulsive elastic waves. Thus, the plyboard construction cannot afford any substantially effective impedance against the impulsive elastic waves transmission through the core structure 3 and the impact load imposed on the bottom structure can easily be transferred to the skier's feet.

Direct transfer of the impact load to the skier's feet gives the skier a hard, and uncomfortable "feel".

An embodiment of the ski in accordance with the present invention is shown in FIG. 2 in a disassembled state for an easy understanding of the present invention. The constructions of the upper and bottom structures 1 and 2 are substantially similar to those of the conventional skis shown in FIGS. 1A through 1C.

This ski, however, is provided with a novel and improved core structure 50 which is comprised of a core body 51 and upper and lower core layers 52 and 53 sandwiching the core body 51 via intermediate bonding layers 54, the core structure 50 being coupled to the upper and bottom structures 1 and 2 in any known manner. The core body 51 is made of a material having a lower Young's modulus, and generally of synthetic resin whereas the upper and lower core layers 52 and 53 are made of a material having a higher Young's modulus, and generally of wood. The bonding layers 54 preferably take the form of glass fiber layers preimpregnated with thermosetting resin.

When impact load F is imposed on the bottom surface of the ski main body having the above-described core structure 50 as shown in FIG. 3, the impulsive elastic waves W reflect at the borders between the core body 51 and the sandwiching core layers 52 and 53 to disperse into random directions in the core structure 50 and interfere with each other. This reflection of the elastic waves is caused by the discontinuty in the mechanical property, i.e. Young's modulus, at the borders between the layers composing the core structure 50. In other words, the core structure in accordance with the present invention functions as a damping element having a high impedance against transmission of the impulsive elastic waves. Thus, only a small portion of the entire elastic waves is allowed to pass through the core structure 50 and reach to the upper structure 1 and accordingly to the skier's feet. Poor transfer of the impact load to skier's feet assures a soft and smooth "feel."

The ski board in accordance with the present invention further assures beautiful ski response due to its high internal energy packed construction, which is hereinafter explained in more detail.

As already, described, the upper and lower core layers 52 and 53 are in general made of wood, the core body 51 is made of a synthetic resin, more generally of a urethane foam and the wood layers 52 and 53 are coupled to the foam layer 51 via the prepreg layers 54, i.e. the glass fiber layers preimpregnated with thermosetting resin.

In the manufacturing of the core structure 50 in accordance with the present invention, the rate of thermal contraction of the foam core body 51 can be minimized by application of annealing. The prepreg layers 54 need to be heated up to about 90° C. in order to bond the wood core layers 52 and 53 to the foam core body 51 and this heat application hardens the thermosetting resin to form solid fiber reinforced plastic (or FRP) layers 54, thereby reducing the entire volume of the initial prepreg material. After the hardening of the prepreg material, the temperature of the core structure 50 is lowered to the level of the room temperature, and this lowering of the temperature causes further contraction of the hardened prepreg layers 54. The total contraction rate of the prepreg material, i.e. the sum of the contractions due to the hardening and temperatue lowering, thus amounts to about 0.1%. The foam core body 51 should theoretically experience about 0.25% of thermal expansion during the above-described heating at 90° C. for hardening of the prepreg layers 54. However, the actual thermal expansion rate of the foam core body 51 due to the 90° C. heating amounts to only about 0.05% as free thermal expansion of the foam core 51 is greatly restrained by the wood core layers 52 and 53 coupled thereto, whose thermal expansion is almost nil.

As the temperature is lowered to room temperature, the foam core body 51 tends to experience 0.05% thermal contraction whereas the prepreg layers 54 tends to undergo 0.1% thermal contraction. This discrepancy in the thermal contraction places the foam core in a compressed state and the prepreg layers in a stretched state in the ski board obtained. Thus, in accordance with the present invention, compression energy is stored in the core body portion and tension energy is stored in the superficial core portion of the core structure, thereby providing the ski with a high internal energy packed construction.

The energy-packed construction of the core structure gives the ski further enhanced characteristics of high responsiveness in addition to those caused by the heterogeneous internal construction of the core structure.

Several combinations are employable for the core body 51 and the sandwiching core layers 52,53 of the present invention. In one embodiment, urethane foam having a Young's modulus ranging from 60 to 100 $kg/mm^2$ may be used for the core body in combination with sandwiching core layers made of a material such as hickory of a Young's modulus ranging from 1,000 to 1,400 $kg/mm^2$ or maple of a Young's modulus ranging from 800 to 1,000 $kg/mm^2$ or nara-tree of a Young's modulus ranging from 1,000 to 1,200 $kg/mm^2$ or beech of a Young's modulus ranging from 800 to 1,000 $kg/mm^2$. As a substitute for urethane foam, ABS foam or Epoxy foam of a Young's modulus ranging from 60 to 100 $kg/mm^2$ may be used for the core body 51. A cavitious core body made of ABS resin or polyester resin is employable, also. For the sandwiching core layers, phenol resin boards having a Young's modulus ranging from 600 to 1,500 kg/mm$^2$ may be substituted for the wooden boards.

In general, the Young's modulus of the material used for the sandwiching core layers 52 and 53 should preferably be in a range from 600 to 1,500 kg/mm$^2$ whereas that of the material used for the core body 51 should preferalby be in a range from 10 to 400 kg/mm$^2$.

The average percent occupation of the sandwiching core layer to the total thickness of the core structure should preferably be in a range from 10 to 40. Provided that the maximum total thickness of each sandwiching core layer of the actual core structure 3 is 18 mm., the total thickness should preferably in a range from 1 to 5mm. When the occupation ratio of the sandwiching core layer of a high Young's modulus exceeds this upper limit value, the ski board exhibits too high ski response. Whereas, when the occupation ratio falls short of this lower limit value, the resultant ski response is too low. The larger the occupation ratio of the sandwiching core layers of high Young's modulus, the higher the resultant ski respnse. Thus, for veteran skiers, the core structure should contain thick sandwiching core layers of high Young's modulus and, for beginners, it should contain thin sandwiching core layers of high Young's modulus.

Though the core body 51 is accompanied by a pair of sandwiching core layers 52 and 53 of high Young's modulus, either one of the layers 52 or 53 may be omitted without substantially lowering the damping effect on the impulsive elastic wave.

It is not necessary that the core layer or layers of high Young's modulus extend over the entire length of the ski main body. An appreciable damping effect can be obtained when the core layer or layers are placed in a region extending forwardly and rearwardly by 25 cm. or longer respectively from the midway point of the total length of the ski main body.

Likewise, it is not necessary that the core structure should extend over the entire width of the ski main body. In the modified embodiment shown in FIG. 4 the core structure 60 includes a plurality of mutually spaced separate core blocks 61*a*, 61*b*, — sandwiched by upper and lower core layers 62 and 63 via respective bonding layers 64*a*, 64*b* —. An appreciable damping effect on the impulsive elastic waves can be obtained when percent occupation of the sandwiching layer in the total width of the core structure is 60 or larger.

A further modification of the embodiment shown in FIG. 3 is illustrated in FIG. 5, in which the core structue 70 comprises a pair of core layers 72 and 73 of higher Young's modulus which are embedded in the upper and lower surfaces of a core body 71 of lower Young's modulus via bonding layers 74, the width of the sandwiching core layers 72 and 73 being smaller than that of the core strucure 70.

A variant of the embodiment shown in FIG. 5 is shown in FIG. 6, in which the core structure 80 comprises a pair of upper core layers 82*a* and 82*b* embedded in both side portions of the upper surface of a core body 81 via bonding layers 84 while leaving an intact center portion of the latter. A lower core layer 83 of a smaller width is embedded in the lower surface of the core body 81 via a bonding layer 84. The outer fringe portions of the lower core layer 83 extend beyond the corresponding inner ends of the upper core layers 82*a* and 82*b*.

I claim:

1. An improved ski comprising an upper structure, a bottom structure and a core structure, said core structure including a core body of a lower Young's modulus and at least one core layer of a higher Young's modulus which layer at least partly covers one of the upper and lower surfaces of said core body, said covering core layer being coupled to said core body by a bonding layer, which is fiber reinforced and contains a thermosetting resin.

2. The improved ski of claim 1, wherein said covering core layer is made of a material having a rate of thermal contraction which is lower than that of said core body.

3. The improved ski as claimed in claim 1 in which the Young's modulus of said covering core layer is in a range from 600 to 1,500 kg/mm$^2$.

4. The improved ski as claimed in claim 1 in which the Young's modulus of said core body is in a range from 10 to 400 kg/mm$^2$.

5. The improved ski as claimed in claim 1 in which the Young's modulus of said covering core layer is in a range from 600 to 1,500 kg/mm$^2$ whereas the Young's modulus of said core body is in a range from 10 to 400 kg/mm$^2$.

6. The improved ski as claimed in claim 1 in which said core body is made of a synthetic resin.

7. The improved ski as claimed in claim 6 in which said synthetic resin is chosen from a group consisting of urethane foam, ABS foam, epoxy foam and polyester resin.

8. The improved ski as claimed in claim 7 in which the Young's modulus of said synthetic resin is in a range from 60 to 100 kg/mm$^2$.

9. The improved ski as claimed in claim 1 in which said covering core layer is made of wood.

10. The improved ski as claimed in claim 9 in which said wood is chosen from the group consisting of hickory, maple, nara-tree and beech.

11. The improved ski as claimed in claim 10 in which the Young's modulus of said wood is in a range from 800 to 1,400 kg/mm$^2$.

12. The improved ski as claimed in claim 1 in which said core body is made of urethane foam having a Young's modulus in a range from 60 to 100 kg/mm$^2$.

13. The improved ski as claimed in claim 12 in which said covering core layer is made of hickory having a Young's modulus in a range from 1,000 to 1,400 kg/mm$^2$.

14. The improved ski as claimed in claim 12 in which said covering core layer is made of maple having a Young's modulus in a range from 800 to 1,000 kg/mm$^2$.

15. The improved ski as claimed in claim 12 in which said covering core layer is made of nara-tree having a Young's modulus in a range from 1,000 to 1,200 kg/mm$^2$.

16. The improved ski as claimed in claim 12 in which said covering core layer is made of beech having a Young's modulus in a range from 800 to 1,000 kg/mm$^2$.

17. The improved ski as claimed in claim 1 in which said covering core layer is made of a phenol resin.

18. The improved ski as claimed in claim 17 in which the Young's modulus of said phenol resin is in a range from 600 to 1,500 kg/mm$^2$.

19. The improved ski as claimed in claim 1 in which the percent occupation of said covering core layer relative to the total thickness of said core structure is in a range from 10% to 40%.

20. The improved ski as claimed in claim 19 in which the total thickness of said covering core layer is in a range from 1 to 5 mm.

21. The improved ski as claimed in claim 1 in which the percent occupation of said covering core layer in the entire width of said core structure is 60% or larger.

22. The improved ski as claimed in claim 1 in which said covering core layer is coupled to said core body in a region extending forwardly and rearwardly by 25 cm or longer, respectively, from the midway point of the entire length of said ski.

23. The improved ski as claimed in claim 1 in which said core body is sandwiched between two covering core layers.

24. The improved ski as claimed in claim 21 in which said covering core layer extends over the entire width of said core structure.

25. The improved ski as claimed in claim 24 in which said core body is comprised of a plurality of core blocks laterally spaced from each other.

26. The improved ski as claimed in claim 1 in which said covering core layer is embedded in the center portion of one surface of said core body while leaving intact fringe portions of the latter.

27. The improved ski as claimed in claim 1 in which said core body is associated with two covering core layers embedded in the fringe portions thereof while leaving the intact center portion of said core body.

* * * * *